US006038722A

United States Patent [19]

Giori et al.

[11] Patent Number: 6,038,722

[45] Date of Patent: Mar. 21, 2000

[54] PRESSURE ADJUSTABLE, ANATOMICALLY CONTOURED MATTRESS

[76] Inventors: Gualtiero G. Giori; Janine Giori, both of Chemin Des Eterpreys 16, 1010 Lavsanne, Switzerland

[21] Appl. No.: 09/227,682

[22] Filed: Jan. 8, 1999

[51] Int. Cl.[7] ..... A47C 27/10; A47C 27/14

[52] U.S. Cl. ..... 5/709; 5/731; 5/735

[58] Field of Search ..... 5/709, 731, 735, 5/632, 723

[56] References Cited

U.S. PATENT DOCUMENTS

| | | | |
|---|---|---|---|
| 3,872,525 | 3/1975 | Lea et al. | 5/709 |
| 4,025,974 | 5/1977 | Lea et al. | 5/709 |
| 4,685,163 | 8/1987 | Quillen et al. | 5/731 |
| 4,688,283 | 8/1987 | Jacobson et al. | 5/709 |
| 5,033,133 | 7/1991 | Nissen | 5/709 |
| 5,279,310 | 1/1994 | Hsien | 5/632 |
| 5,669,092 | 9/1997 | Lin | 5/709 |
| 5,720,061 | 2/1998 | Giori et al. | 5/735 |

*Primary Examiner*—Alexander Grosz
*Attorney, Agent, or Firm*—William E. Noonan

[57] ABSTRACT

A pressure adjustable, anatomically contoured mattress includes an elongate body supporting member that has a resilient, air pressure adjustable, self-inflating foam core and a flexible covering that encloses the core. The body supporting member further includes a contoured recess formed in an upper surface of the body supporting member and extending laterally relative thereto. The recess accommodates the breasts of the female user lying face down on the body supporting member. The recess also accommodates the shoulder of a user lying sideways on the mattress. One or more valves are connected communicably to the core and extend through the covering. The valves are opened to exhaust air from and at least partially collapse the core and, alternatively, to allow a core that is at least partially collapsed, to draw in air and expand. The valves are closed for maintaining a selected air pressure within the core.

11 Claims, 4 Drawing Sheets

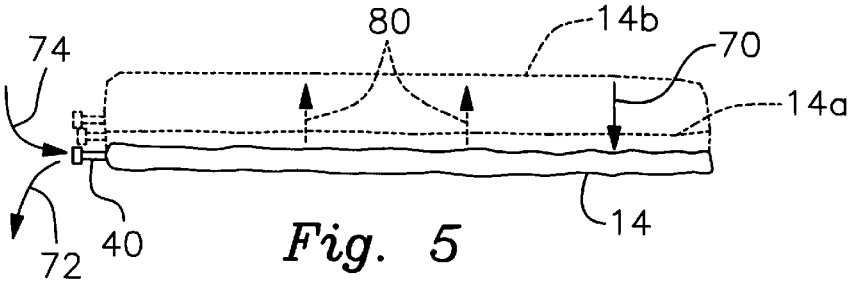
Fig. 5
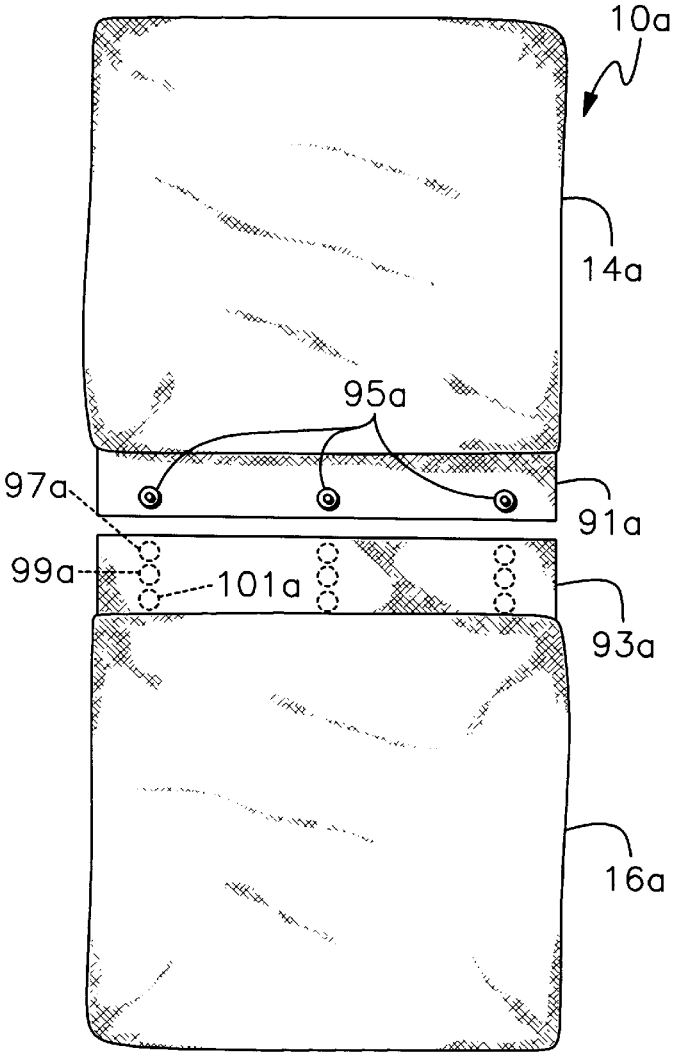
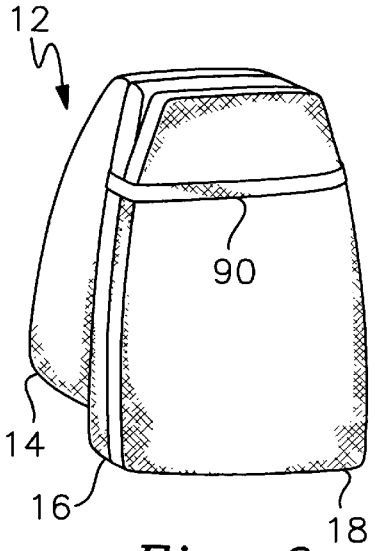
Fig. 6
Fig. 7

PRESSURE ADJUSTABLE, ANATOMICALLY CONTOURED MATTRESS

FIELD OF THE INVENTION

This invention relates to a pressure adjustable mattress that is anatomically contoured for comfortable use by both men and women.

BACKGROUND OF THE INVENTION

U.S. Pat. No. 5,720,061 relates to a FEMALE ANATOMICAL MATTRESS wherein I disclose a mattress that enables a woman to lie comfortably on her stomach, while allowing her breasts to rest within a cavity in the mattress. Although this mattress constitutes a significant improvement over previous anatomical mattresses, I have recognized the need for still additional improvements in products of this type. For example, it would be desirable to provide a mattress that provides anatomical contouring for men as well as women. Conventional recreational mattresses used for sunbathing, massage and other indoor/outdoor applications do not comfortably accommodate and support a man's shoulders, particularly when the user is lying on his side.

I have also recognized that standard mattresses are usually not conveniently collapsible so that they may be quickly and compactly broken-down, stored and/or transported between uses. Moreover, it is usually quite difficult to adjust the internal air pressure of the mattress so that it provides a precisely selected level of firmness. Inflating a standard air mattress is time consuming and exhausting. It is virtually impossible to quickly and easily achieve the desired firmness.

SUMMARY OF INVENTION

It is therefore an object of the present invention to provide a pressure adjustable, anatomically contoured mattress that is extremely comfortable for both men and women to use and which supports the user so that bodily pain and discomfort are significantly reduced.

It is a further object of this invention to provide a contoured mattress that comfortably and naturally accommodates a woman's breasts while the user is lying face down on the mattress.

It is a further object of this invention to provide a contoured mattress that comfortably accommodates the shoulder of a user who is lying on his or her side.

It is a further object of this invention to provide a contoured mattress that comfortably stretches the lumbar or lower back region of the user.

It is a further object of this invention to provide a contoured mattress that is quickly, conveniently and accurately pressure adjustable so that a desired level of firmness or softness may be attained.

It is a further object of this invention to provide a contoured mattress that may be quickly and conveniently collapsed when not in use and which is easily stored or transported.

It is a further object of this invention to provide a pressure adjustable, contoured mattress that is an esthetically attractive and which may be utilized in a wide variety of indoor and outdoor applications.

It is a further object of this invention to provide a contoured mattress that is buoyant and may be used as a recreational float.

This invention features a pressure adjustable anatomically contoured mattress. The mattress includes an elongate, body supporting member that has a resilient, air pressure adjustable foam core and a flexible covering that encloses the core. The body supporting member further includes a contoured recess formed in an upper surface of the body supporting member and extending laterally relative thereto. The recess accommodates the breasts of a female user lying face down on the body supporting member. The recess also supports the shoulder of a user lying sideways on the body supporting member. There are valve means connected communicably to the core and extending through the covering. The valve means are opened for exhausting air from and at least partially collapsing the core, and for allowing a core that is at least partially collapsed, to draw in air and expand. The valve means are closed for maintaining a selected air pressure within the core.

In a preferred embodiment, the contoured recess is convexedly curved longitudinally relative to the body supporting member. The body supporting member may include a plurality of longitudinally juxtaposed and foldably interconnected support sections. Each support section may include a portion of the foam core and a portion of the covering that encloses the foam core portion. The support sections may include a head support section that is engaged by the head of a user and a second support section that is foldably attached and immediately adjacent to the head support section. The recess may include a contoured upper surface of the head support section and an angled leading end of the second section. The recess may further include a flexible strip interconnecting the head section and the second support section. The head support section may include a generally convexedly curved lower segment, which defines at least a portion of the recess. A third support section may be foldably attached and immediately adjacent to the second section. Each pair of adjacent support sections may be foldably connected by a respective flexible strip that extends laterally across the body supporting member. The support sections may be releasably and/or longitudinally adjustably interconnected. The head section may include a rounded upper end that is curved from an upper surface to a lower surface of the head section.

The valve means may include a plurality of valves and each of at least two foam core portions may carry one or more valves. Typically, the valves comprise standard threaded drain valves that are communicably connected to the core. The drain valves are screwed opened or closed as required.

The foam core may include an opened-celled foam. The covering may be heat sealed to the foam and may include an exterior layer and an inner backing that is interposed between the exterior layer and the foam core. A soft fabric jacket may be removably attached to the body supporting member. A pouch may be formed in the jacket. Strap means may be attached to one of the support sections for holding the support sections in a folded condition.

DETAILED DESCRIPTION OF PREFERRED EMBODIMENTS

Other objects, features and advantages will occur from the following description of preferred embodiments and the accompanying drawings, in which:

FIG. 5 is an elevational side view of one of the mattress sections in a collapsed condition and illustrating how that section expands when the valve is opened;

FIG. 6 is a perspective view of the mattress in a folded condition with the support section strapped together; and FIG. 7 is a plan view of a mattress featuring longitudinally adjustable and detachable means for connecting adjacent mattress sections.

Figure 1:
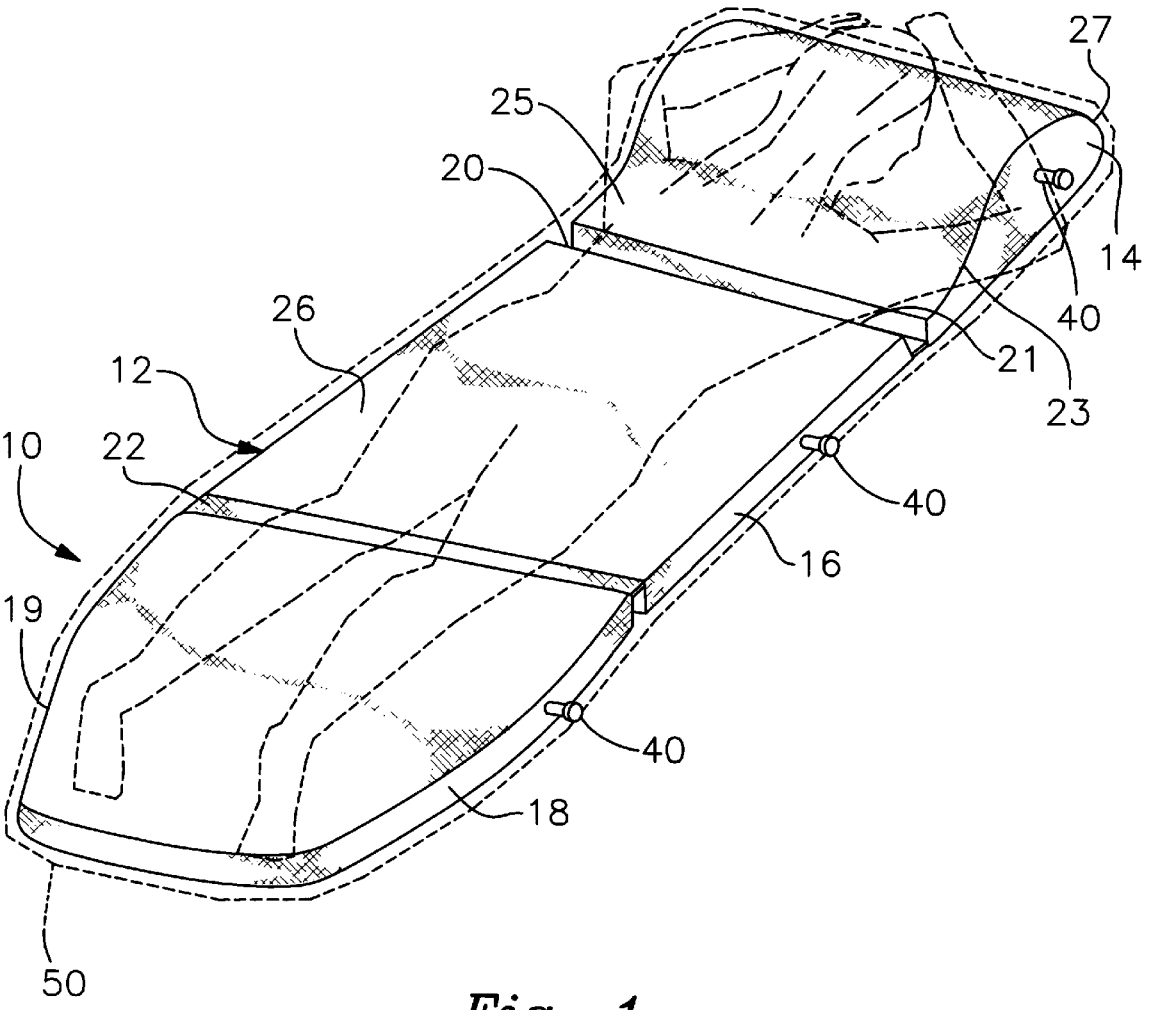
FIG. 1 is a perspective view of a pressure adjustable, anatomically contoured mattress according to this invention; the mattress is depicted with the fabric cover in phantom, which cover will normally cover the mattress in use; a female user is shown also lying face down on the mattress.
Figure 2:
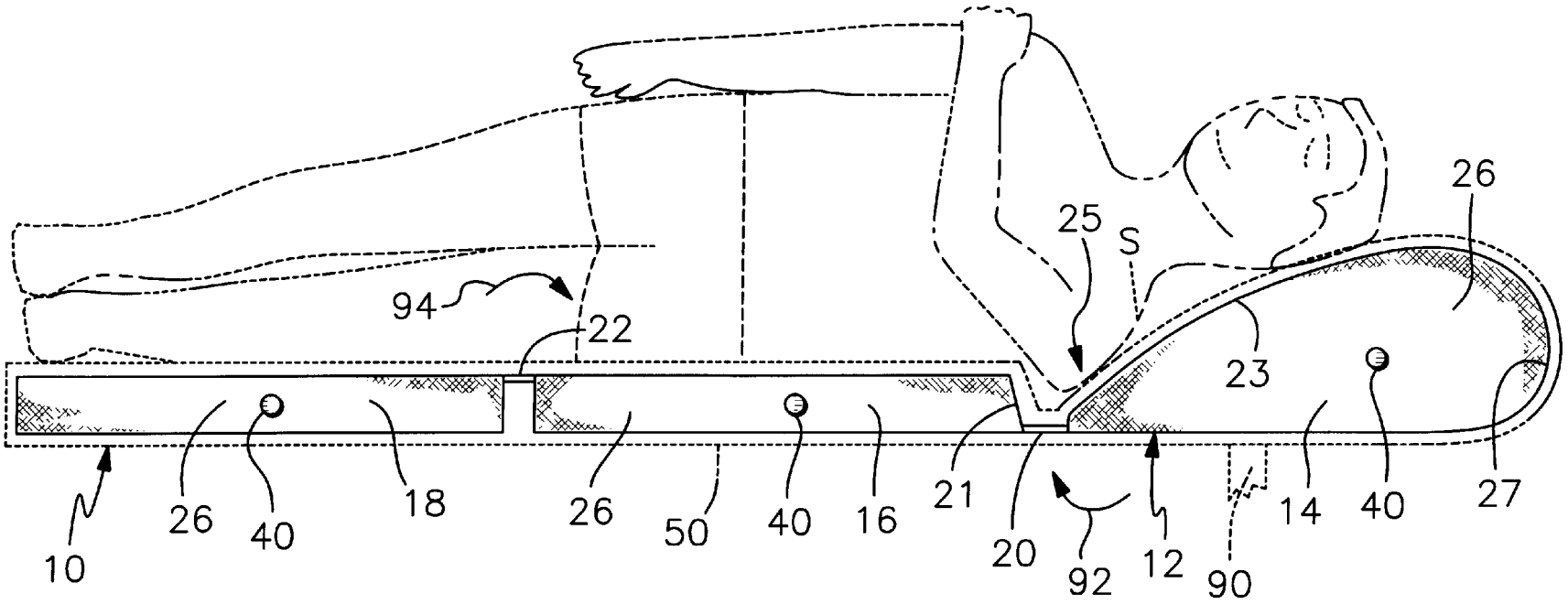
FIG. 2 is an elevational side view of the mattress with a user lying sideways thereon.

There is shown in FIGS. 1 and 2 a collapsible, pressure adjustable contoured mattress 10, which includes an elongate, body supporting member 12. The body supporting member comprises a body length plastic covered foam cushion having three foldably interconnected support sections 14, 16 and 18 arranged longitudinally from head to toe of the user. More particularly, the upper or head support section 14 supports the user's head; a second, middle section 16 generally supports the user's torso; and a third or lower support section 18 is engaged by the user's legs. Cushioned head section 14 is foldably interconnected to second support section 16 by an elongate flexible strip 20. Likewise, second section 16 is foldably interconnected to third support section 18 by a flexible plastic strip 22. Strips 20 and 22 extend laterally across support member 12 from one longitudinal edge to the opposite longitudinal edge in the manner best shown in FIG. 1.

Second and third support sections 16 and 18 feature a substantially flat or planar construction, best shown in FIG. 2. As depicted in FIG. 1, the lower end of third support section 18 may include a taper 19. Second support section 16 has a generally rectangular peripheral shape. The upper end 21 of second support section 16 includes a slope, taper or angle. Cushioned head section 14 includes a contoured upper surface 23. More particularly, the upper surface of head section 14 includes a convexedly curved shape extending longitudinally relative to member 12. Curved upper surface 23, flexible connecting strip 20 and angled end 21 of section 16 define a recess 25. The function of this recess is described more fully below. The upper end of head section 14 is rounded and includes a curvature 27 that extends between the upper surface and the bottom surface of the head section.

Figure 3:
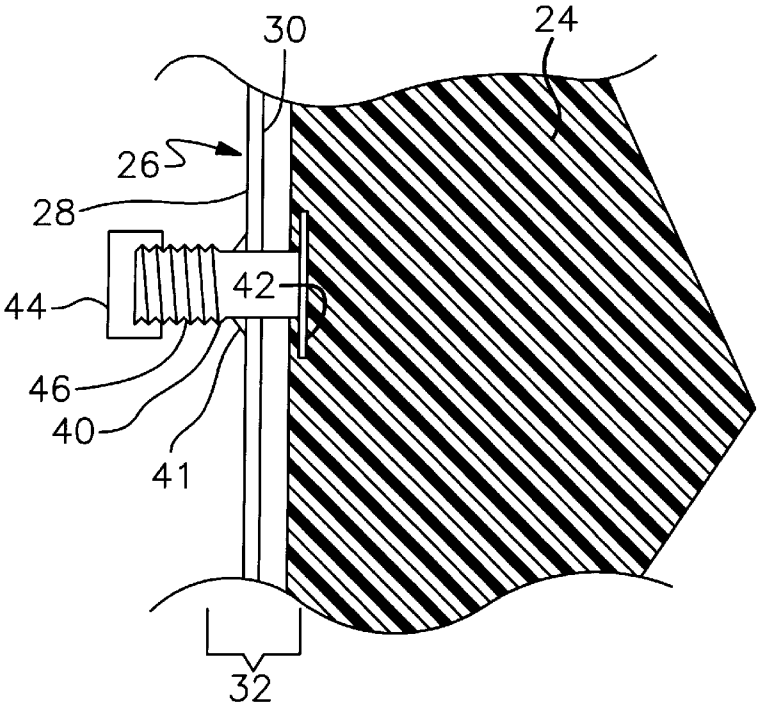
FIG. 3 is a cross sectional view of the foam core, the covering and one of the drain valves communicably connected to the foam core; these components are simplified and spaced slightly apart for clarity and illustrative purposes.

Each of the support sections is composed in the manner best shown in FIG. 3. In particular, each cushioned support section includes a resilient, self inflatable foam core portion 24. The core portion typically comprises an open-celled, air pressure adjustable foam such as polyurethane. This material should be capable of being alternately filled with air or exhausted of air as required. Various alternative foam materials may be used within the scope of this invention. The individual core portions 24 together define a foam core of the mattress.

Each of the core portions 24 is enclosed by an exterior covering 26 (see also FIGS. 1 and 2). The covering should comprise a durable, airtight and preferably waterproof material. Typically the covering comprises individual pieces or segments respectively covering the top, bottom and sides of each foam portion. These pieces are interconnected by various known manners such as sewing or RF welding. The latter technique is especially preferred because it renders the mattress essentially airtight and watertight. This permits the mattress to be used as a float. Each piece of the covering comprises a multiple layer construction. For example, as shown in FIG. 3, the covering includes a flexible outer layer 28 composed of a sheet-like material such as nylon. Covering 26 also includes an inner, sheet-like backing layer 30, composed of polyurethane, PVC or similar plastic material. The backing is interposed between outer nylon layer 28 and foam core 24. Exterior layer 28 and interior backing layer 30 are shown separated from each other, as well as from foam core portion 24, for clarity. Layers 26 and 28 are heat sealed together, as indicated by bracket 32 in FIG. 3. The entire exterior surface of each foam portion is enclosed by a respective covering portion in this manner such that the three support sections 14, 16 and 18 are formed and separated in the manner shown in FIGS. 1 and 2. The individual covering portions 26 collectively define the exterior covering of the mattress. Plastic nylon strips 20 and 22 may be formed unitarily with the flexible nylon covering. Alternatively, the interconnecting strips may be attached between the respective support sections by sewing, RF sealing or other appropriate means. In still other versions, the cushion support sections may be releasably interconnected such as by complementary plastic clip or snap components that are heat sealed into or punched through the plastic covering segments. Other means of detachable interconnection may be used. Such structure allows mattress sections to be added or deleted as desired. This feature is illustrated and described more fully below in connection with FIG. 7.

Valve means are employed by mattress 10 for the purpose of selectively collapsing and expanding the cushioned support sections. In the version shown herein, each support section is equipped with a respective drain valve 40. A representative one of the valves 40 is depicted in FIG. 3. Each valve 40 carries an annular flange 42 at its inner end. Flange 42 is secured by heat-sealing or other means to a respective foam core portion 24 such that valve 40 is communicably connected to the foam core portion. The drain valve extends outwardly through the layers of flexible covering 26 such that its outer end or cap 44 is exposed. Valve 40 is heat sealed at 41 onto the nylon outer layer 28. In the embodiment disclosed herein, each of the support sections is provided with a single associated valve 40. However, in alternative embodiments, two or more valves may be provided for some or all of the body support sections.

Each of the drain valves 40 is a standard, off-the-shelf item that operates in a manner known to those skilled in the art. In particular, valve 40 is opened by loosening or unscrewing cap 44 relative to valve body 46. Alternatively, by tightening or screwing cap 44 onto valve body 46, valve 40 is closed. This prevents the air from being introduced into or exhausted from the open-celled foam core portion 24.

Figure 4:
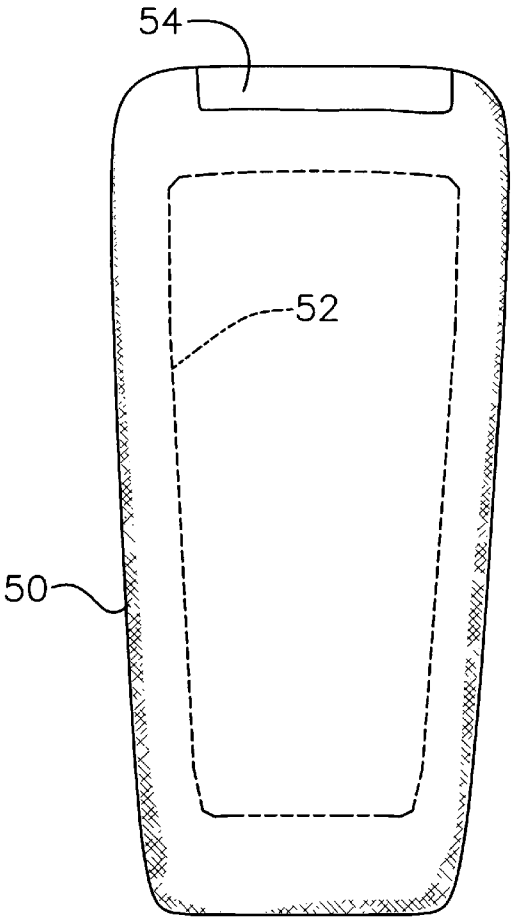
FIG. 4 is a top plan view of a flexible fabric cover that is used with this mattress.

As shown in phantom in FIGS. 1 and 2, body supporting member 12 is covered by a soft fabric jacket 50. Jacket 50, which is shown alone in FIG. 4, comprises an attractive and comfortable material such as a mixed cotton/synthetic fabric. The jacket may include a plastic backing, which renders the fabric non-porous but readily washable. The fabric may be treated with an UV retardant as well as an appropriate stain guard and/or fabric protectant. The jacket is constructed in a manner analogously to a standard mattress pad or sheet. An opening 52 is formed in the jacket. That opening is typically bordered by an elastic or resilient material that allows the opening to be expanded so that the jacket may be quickly and conveniently fitted onto or removed from the underlying support member 12. As best shown in FIG. 4, jacket 50 has a shape that generally conforms to the peripheral shape of the cushioned support member. An optional pouch 54 for accommodating sun glasses, sun tan lotion and other items may be formed proximate the upper end of the jacket or at other locations therein.

To use mattress 10, the cushioned body supporting member 12 is unfolded and positioned on the ground, pool deck, lounge chair, etc., in the manner shown in FIGS. 1 and 2. Initially, the valves 40 may have to be opened so that the sections of the open-celled foam core 24 are expanded and fully self-inflated by the outside air. When each of the support sections is expanded to the degree desired, the respective valves 40 are closed so that the air is retained within foam core portion 24 is maintained at a desired internal air pressure. The user may then recline on the mattress in the manner shown in FIGS. 1 and 2. Preferably, the comfortable protective jacket 50 is installed over the body support member prior to use.

As shown in FIG. 1, this mattress is particularly convenient and comfortable for use by a female lying face down on the mattress. The user reclines such that her head rests against head support section 14. This positions the user such that her breasts are comfortably accommodated within recess 25. The breasts rest in a natural position. The cavity or recess eliminates compression of the breasts and undue pressure on the shoulders. This in turn significantly reduces arching of the middle back and tension in the neck. The convex curvature of section 14 firmly, naturally and comfortably supports the user. The mattress is effective for use by all women and particularly women having breast implants. Alternatively, recess 25 serves in the manner shown in FIG. 2 to accommodate the shoulder of a user. The contoured shape of the recess and the cushioned body support sections provide improved, comfortable support to a user lying on his or her side. This is a particularly advantageous feature for men, who typically have larger shoulders. Because all portions of the user's body are equally supported when the user lies on his or her side, this structure benefits persons suffering from stiff shoulders. The rounded upper end 27 of section 14 also is contoured so that the user's arms lie in a comfortably natural position about the head. It has also been found that the user's lumbar or lower back region is comfortably supported and stretched by the mattress when the user lies upon his or her back.

The valves 40 permit mattress 10 to be selectively collapsed and re-expanded. As used herein, "collapse" means to either partially or fully exhaust air from one or more of the foam core portions 24. This achieves several advantageous benefits. In particular, the product can be quickly collapsed for convenient transportation and storage when not in use. Additionally, the internal air pressure within the foam core portions can be readily fine-tuned to provide the mattress with a desired firmness or softness. Air is released to soften or fully collapse the body support sections by unscrewing cap 44, FIG. 3, and squeezing the foam core to exhaust air through drain valve 40. When the core is deflated or collapsed to the degree desired, cap 44 is retightened on valve body 46 to close valve 40. Air is thereby prevented from further escaping or from being drawn in by the resilient foam core portion. As a result, the foam core portion and the respective body support section are maintained at a precisely selected air pressure and firmness. Deflating or slightly collapsing the foam core portion typically provides for softer cushioning.

The cushioned body support sections are fully deflated or collapsed, and subsequently re-expanded in the manner shown in FIG. 5. In particular, head support section 14 is shown therein. However, it should be understood that the principles of this operation apply equally to the other body support sections. With valve 40 open, the user squeezes head section 14, as illustrated by arrow 70, into a flat condition. This causes air to be expelled or exhausted through valve 40 in the direction of arrow 72. After section 14 is fully collapsed, valve 40 is immediately closed so that air cannot be drawn back into the foam core of that support section and the foam core cannot re-expand. When all three body support sections are collapsed in this manner, the entire body support member may then be rolled-up, folded and stored or transported in a convenient fashion.

To subsequently re-inflate the collapsed mattress, the valve or valves 40 are opened. This causes the collapsed foam core to draw in through the open valve 40 as indicated by arrows 74. The foam core portions and the respective body support sections expand as indicated by arrows 80. The user permits each body support section of the mattress to expand to a desired internal air pressure. For example, section 14 may be allowed to expand to the semi-inflated condition 14*a* illustrated in phantom or to the fully expanded original condition 14*b* also illustrated in phantom. Once again, the firmness or softness of the cushion may be selected to suit the requirements of the individual user. When the mattress is expanded to the level desired, the valves are closed. It should be noted that if the mattress is stored for long periods of time in its deflated state, the user may subsequently assist re-inflation by first introducing a few breaths of air into the collapsed mattress to restore foam loft. This typically permits the foam to then completely expand on its own.

As shown in FIG. 6, an elongate, typically elastic strap 90 may be carried by support member 12. Strap 90 extends transversely across the support member and is attached to opposing edges of head section 14. The mattress is folded in the manner shown in FIG. 6 by initially removing jacket 50. The support sections 14, 16 and 18 are then folded along connecting strips 20 and 22. In particular, the lower surfaces of head section 14 and second support section 16 are folded against one another, as indicated by arrow 92 in FIG. 2. Likewise, the upper surface of third support section 18 is folded against the upper surface of second support section 16, as indicated by arrow 94. Strap 90 extends transversely across the bottom surface of head section 14, again best shown in FIG. 2. When the body support sections are folded in the above-described manner, the user grasps strap 90, expands the strap and pulls it over the folded sections 16 and 18. The strap is then engaged with the bottom surface of support section 18 in the manner shown in FIG. 6. This holds the folded body support sections together so that the mattress may be conveniently stored or transported. The use of the strap is particularly effective when the support sections remain fully inflated or expanded while not in use. It should also be noted that a handle or carrying strap may also be attached at any appropriate location on the device. A pair of handles may be employed to facilitate climbing onto the mattress in water and for transport. A tote case may also be used for transporting the mattress.

The above construction and, in particular, the use of open-cell foam and waterproof nylon, as well as a jacket with plastic backing, renders the mattress buoyant. As a result, it is convenient to use as a recreational floatation device at the beach and pool.

An alternative mattress 10*a* is shown in FIG. 7. Therein, a cushioned head support section 14*a* is adjustably and releasably interconnectable with a second cushioned support section 16*a*. The cushioned sections 14*a* and 16*a* are constructed largely in the manner previously described. Each cushioned section includes an interior open-celled foam that is enclosed by a flexible, waterproof and airtight covering. Air valves for selectively inflating and deflating the cushioned sections may also be provided, although they are not shown in FIG. 7. In this embodiment, the respective cushioned sections are releasably interconnected. In particular, head section 14*a* carries a plastic segment 91*a* that is attached by a seam or heat weld along to the lower end of the head section. Middle section 16*a* carries a similar plastic strip 93*a* that is attached to an upper end of the cushioned middle section of the mattress. Three female snap elements 95*a* are carried by the upper surface of strip 91*a*. Three rows 97*a*, 99*a* and 101*a* of male snap elements are carried by the bottom surface of strip 93*a*. Each row of snap elements includes three such elements, which are aligned with respective female snap elements 95 carried by strip 91*a*. The male and female snap elements are aligned and interengaged to releasably interconnect the cushioned sections 14*a* and 16*a*. The length of the mattress may be adjusted by interconnecting female snap elements 95*a* to respective male snap elements contained in either row 97*a*, 99*a* or 101*a*. For example, the mattress in lengthened by interconnecting female snap elements 95*a* with the male snap elements of row 97*a*. Conversely, the mattress is shortened by engaging the female snap elements with the male snap elements of row 101*a*. By adjusting the distance between the cushioned sections 14*a* and 16*a*, the user also adjusts the width of the recess formed in the mattress. This enables the mattress to be adapted for use by persons having varying body contours and configurations. Additionally, when the product is not in use, the individual cushioned sections can be detached from one another completely for transportation and storage by simply disengaging the interconnected snap fasteners. It should also be understood that one or more additional cushioned sections may be releasably added to the mattress in a similar manner and using analogous structure.

The mattress of this invention may be manufactured in one of a number of ways. For example, a piece of plastic covering may be initially heat sealed onto the front or upper surface of a foam section. Next, a second piece of plastic covering is RF sealed along all sides of the foam to the first piece of plastic to create a seam with a small flange. The second piece of plastic covers the lower or bottom surface of the foam section without adhering to the foam. All cushioned sections of the mattress are manufactured in this manner and then attached together by means of sewing or heat sealing.

Alternatively, the plastic covering may first be RF sealed to itself along peripheral seams to create a casing for a section of foam. One of the four sides of this casing is permitted to remain open so that foam may be introduced into the casing. Next, the foam may be collapsed by vacuuming the air from it. The foam segment is then placed inside the prepared casing in a collapsed state. After the foam has expanded in its casing, the fourth side is RF sealed. This totally encapsulates the foam. Once again, each section of the mattress is constructed in this manner and the sections are then attached together by sewing or heat sealing.

Accordingly, the subject invention comfortably supports the user and provides particularly advantageous support for a women's breasts and any user's shoulders. The drain valves allows the cushioning and comfort levels to be quickly and conveniently, adjusted and selected to meet the needs of the user.

Although specific features of the invention are shown in some drawings and not others, this is for convenience only, as each feature may be combined with any or all of the features in accordance with this invention. Other embodiments will occur to those skilled in the art within the following claims.

What is claimed is:

1. A pressure adjustable, anatomically contoured mattress comprising:

an elongate, body supporting member that includes a resilient, air pressure adjustable, self-inflating foam core and a flexible covering that encloses said core, said body supporting member further including a contoured recess formed in an upper surface of said body supporting member and extending laterally relative thereto, said recess accommodating the breasts of a female user lying face down on said body supporting member, said contoured recess including a convex curve formed in said head section and extending longitudinally relative to said body supporting member, said body supporting member including a plurality of longitudinally juxtaposed and foldably interconnected support sections, each support section including a portion of said foam core and a portion of said covering that encloses said foam core portion, said support sections including a head section that is engaged by the head of a user and a second support section that is foldably attached to and immediately adjacent to said head section, said recess including a contoured upper surface of said head section and an angled leading end of said second support section, at least two of said longitudinally juxtaposed support sections being releasably connected to one another, said support sections further including a third support section foldably attached and immediately adjacent to said second section, said covering including an exterior layer and an inner backing that is interposed between said exterior layer and said core; and valve means connected communicably to said core and extending through said covering, said valve means being opened for exhausting air from and at least partially collapsing said core, and for allowing a core that is at least partially collapsed to draw in air and expand, said valve means being closed for maintaining a selected air pressure within said core.

2. The mattress of claim 1 in which said recess further includes a flexible strip foldably interconnecting said head section and said second support section.

3. The mattress of claim 1 in which each pair of adjacent support sections is foldably connected by a flexible strip that extends laterally across said body supporting member.

4. The mattress of claim 1 in which said recess is contoured to generally conformably accommodate the shoulders of a user lying sideways on said body supporting member.

5. The mattress of claim 1 in which said valve means include plurality of valves and wherein each core portion is communicably connected to a valve that extends through and exteriorly of said covering.

6. The mattress of claim 1 in which said covering is heat sealed to said foam.

7. The mattress of claim 1 in which said head section includes a rounded upper end that is curved from an upper surface to a lower surface of said head section.

8. The mattress of claim 1 further including a fabric jacket that is removably attached to said body supporting member.

9. The mattress of claim 1 further including strap means attached to one of said support sections for holding said support sections in a folded condition.

10. The mattress of claim 1 in which said foam core includes an open-celled foam.

11. A pressure adjustable, anatomically contoured mattress comprising:

an elongate, body supporting member that includes a resilient, air pressure adjustable, self-inflating foam core and a flexible covering that encloses said core, said body supporting member further including a contoured recess formed in an upper surface of said body supporting member and extending laterally relative thereto, said recess accommodating the breasts of a female user lying face down on said body supporting member, said contoured recess including a convex curve formed in said head section and extending longitudinally relative to said body supporting member, said body supporting member including a plurality of longitudinally juxtaposed and foldably interconnected support sections, each support section including a portion of said foam core and a portion of said covering that encloses said foam core portion, said support sections including a head section that is engaged by the head of a user and a second support section that is foldably attached to and immediately adjacent to said head section, said recess including a contoured upper surface of said head section and a leading end of said second support section, at least two of said longitudinally juxtaposed support sections being releasably connected to one another, said support sections further including a third support section foldably attached and immediately adjacent to said second section, said covering including an exterior layer and an inner backing that is interposed between said exterior layer and said core; and valve means connected communicably to said core and extending through said covering, said valve means being opened for exhausting air from and at least partially collapsing said core, and for allowing a core that is at least partially collapsed to draw in air and expand, said valve means being closed for maintaining a selected air pressure within said core.

* * * * *